US010703980B2

(12) United States Patent
Tibah et al.

(10) Patent No.: US 10,703,980 B2
(45) Date of Patent: Jul. 7, 2020

(54) ASPHALT BLOW STILL WITH SECTIONALIZED COLUMNS

(71) Applicants: Denis Muki Tibah, Waxahachie, TX (US); Daniel E. Boss, Cedar Knolls, NJ (US); Nicholas R. Soto, Streetman, TX (US)

(72) Inventors: Denis Muki Tibah, Waxahachie, TX (US); Daniel E. Boss, Cedar Knolls, NJ (US); Nicholas R. Soto, Streetman, TX (US)

(73) Assignee: Building Materials Investment Corporation, Wilmington, DE (US)

( * ) Notice: Subject to any disclaimer, the term of this patent is extended or adjusted under 35 U.S.C. 154(b) by 200 days.

(21) Appl. No.: 15/716,997

(22) Filed: Sep. 27, 2017

(65) Prior Publication Data

US 2018/0086982 A1 Mar. 29, 2018

Related U.S. Application Data

(60) Provisional application No. 62/400,399, filed on Sep. 27, 2016.

(51) Int. Cl.
*C10C 3/04* (2006.01)

(52) U.S. Cl.
CPC ..... *C10C 3/04* (2013.01)

(58) Field of Classification Search
None
See application file for complete search history.

(56) References Cited

U.S. PATENT DOCUMENTS

| | | | | |
|---|---|---|---|---|
| 1,782,186 | A | 11/1930 | Abson | |
| 2,179,208 | A | 11/1936 | Burk et al. | |
| 2,099,448 | A * | 11/1937 | McNeil | C10C 3/04 196/106 |
| 2,200,914 | A | 5/1940 | Burk et al. | |
| 2,375,117 | A | 5/1945 | Lentz | |
| 2,450,756 | A | 10/1948 | Hoiberg | |
| 2,762,755 | A | 9/1956 | Kinnaird, Jr. | |
| 2,762,756 | A | 9/1956 | Kinnaird, Jr. | |
| 3,126,329 | A | 3/1964 | Fort | |
| 4,338,137 | A | 7/1982 | Goodrich | |
| 4,584,023 | A | 4/1986 | Goodrich | |
| 7,901,563 | B2 | 3/2011 | Ruan et al. | |
| 2012/0132565 | A1 | 5/2012 | Aldous | |
| 2014/0262935 | A1 | 9/2014 | Soto et al. | |

* cited by examiner

*Primary Examiner* — Derek N Mueller
(74) *Attorney, Agent, or Firm* — Alvin T. Rockhill; Joshua C. Malino

(57) ABSTRACT

It has been discovered that the efficiency of asphalt blow stills can be improved by sectionalizing the blow still with perforated plates at various heights within the blow still. The perforated plates which contain a multitude of holes act to reduce air bubble size and improve the dispersion of the air bubbles throughout the asphalt flux. This increases the total surface area per unit volume of the air bubbles and promotes a faster processing time. The perforated plates also increase the contact time between the air bubbles and the asphalt flux which further results in improved efficiency and reduced blow times. This is beneficial because faster processing times can be achieved resulting in more efficient use of equipment, higher levels of productivity, lower energy requirements, cost savings, reduce blow loss, and reduced thermal history to which the asphalt is exposed.

21 Claims, 3 Drawing Sheets

ASPHALT BLOW STILL WITH SECTIONALIZED COLUMNS

This application claims benefit of U.S. Provisional Patent Application Ser. No. 62/400,399, filed on Sep. 27, 2016. The teachings of U.S. Provisional Patent Application Ser. No. 62/400,399 are incorporated herein by reference in their entirety.

FIELD OF THE INVENTION

The invention relates to an improved blow still for air blowing asphalt to produce industrial asphalt faster with lower energy requirements, and with less blow loss.

BACKGROUND OF THE INVENTION

Asphalt offers outstanding binding and waterproofing characteristics. These physical attributes of asphalt have led to its widespread utilization in paving, roofing, and waterproofing applications. For instance, asphalt is used in manufacturing roofing shingles because it has the ability to bind sand, aggregate, and fillers to the roofing shingle while simultaneously providing excellent water barrier characteristics.

Naturally occurring asphalts have been used in various applications for hundreds of years. However, today virtually all of the asphalt used in industrial applications is recovered from the refining of petroleum. Asphalt, or asphalt flux, is essentially the residue that remains after gasoline, kerosene, diesel fuel, jet fuel, and other hydrocarbon fractions have been removed during the refining of crude oil. In other words, asphalt flux is the last cut from the crude oil refining process.

To meet performance standards and product specifications, asphalt flux that is recovered from refining operations is normally treated or processed to attain desired physical characteristics and to attain uniformity. For instance, asphalt that is employed in manufacturing roofing products typically needs to be treated to meet the special requirements demanded in roofing applications. More specifically, in the roofing industry it is important to prevent asphaltic materials from flowing under conditions of high temperature, such as those encountered during hot summers. In other words, the asphaltic materials used in roofing products should maintain a certain level of stiffness (hardness) at high temperatures. This increased level of stiffness is characterized by a reduced penetration value, an increased viscosity, and an increased softening point.

To attain the desired set of properties needed in many applications, such as in manufacturing roofing tiles, the base asphalt flux is normally air blown to attain the required level of stiffness. During the air blowing procedure the asphalt reacts with oxygen in the air which results in it having a lower penetration value and a higher softening point. Air blowing catalysts are frequently added to the asphalt flux being air blown to reduce the time needed to attain the desired increase in softening point and reduction in penetration value. Various chemicals and/or polymer modifiers are also frequently added to the asphalt (before or after air blowing) to attain the desired combination of properties needed in the particular application in which the asphalt will ultimately be used.

In conventional air blowing methods air is pumped through the asphalt flux for a period of about 2 to about 10 hours while it is maintained at an elevated temperature which is typically within the range of 400° F. (204° C.) to 550° F. (288° C.). The air blowing process optimally results in the stiffness and the softening point of the asphalt flux being significantly increased. This is highly desirable because ASTM D 3462-96 (Standard Specification for Asphalt Shingles Made from Glass Felt and Surfaced with Mineral Granules) requires roofing asphalt to have a softening point which is within the range of 190° F. (88° C.) to 235° F. (113° C.) and for the asphalt to exhibit a penetration at 77° F. (25° C.) of above 15 dmm (1 dmm=0.1 mm). In fact, it is typically desirable for asphalt used in roofing applications to have a penetration which is within the range of 15 dmm to 35 dmm in addition to a softening point which is within the range of 185° F. (85° C.) to 235° F. (113° C.).

In typical air blowing techniques the oxygen containing gas is introduced and distributed into the bottom 14 of an un-agitated blow still 15 through spargers 16. Once the oxygen containing gas (air) is in the system it travels up through the asphalt 17 and ultimately reaches the surface of the asphalt 8 at the top of the blow still as illustrated in FIG. 1. As the air travel through the asphalt from the bottom to the top of the blow still it is available to react with the asphalt flux being oxidized. The rate of chemical reactions occurring within the blow still is known to be limited by the diffusion of oxygen in the air bubbles traveling through the system. It is also known that mechanical agitation has a significant effect on the oxidation processing time by increasing the surface area of the air bubbles in the system. In any case, conventional asphalt oxidation techniques are currently mass transfer limited.

Air blowing has been used to increase the softening point and stiffness of asphalt since the early part of the twentieth century. For example, U.S. Pat. No. 2,179,208 describes a process wherein asphalt is air blown at a temperature of 300° F. (149° C.) to 500° F. (260° C.) in the absence of a catalyst for a period of 1 to 30 hours after which time a polymerization catalyst is added for an additional treatment period of 20 to 300 minutes at a temperature of 225° F. (107° C.) to 450° F. (232° C.).

Over the years a wide variety of chemical agents have been used as air blowing catalysts. For instance, ferric chloride, $FeCl._3$ (see U.S. Pat. No. 1,782,186), phosphorous pentoxide, $P_2O_5$ (see U.S. Pat. No. 2,450,756), aluminum chloride, $AlCl_3$ (see U.S. Pat. No. 2,200,914), boric acid (see U.S. Pat. No. 2,375,117), ferrous chloride, $FeCl_2$, phosphoric acid, $H_3PO_4$ (see U.S. Pat. No. 4,338,137), copper sulfate CuSO, zinc chloride $ZnCl_2$, phosphorous sesquesulfide, $P_4S_3$, phosphorous pentasulfide, $P_2S_5$, and phytic acid, $C_6H_6O_6(H_2PO_3)_6$ (see U.S. Pat. No. 4,584,023) have all been identified as being useful as air blowing catalysts.

U.S. Pat. No. 2,179,208 discloses a process for manufacturing asphalts which comprises the steps of air-blowing a petroleum residuum in the absence of any added catalysts while maintaining the temperature at about 149° C. to 260° C. (300° F. to 500° F.) and then heating the material at a temperature at least about 149° C. (300° F.) with a small amount of a polymerizing catalyst. Examples of such polymerizing catalysts include chlorosulphonic, phosphoric, fluoroboric, hydrochloric, nitric or sulfuric acids and halides as ferric chloride, aluminum bromide, chloride, iodide, halides similarly of copper, tin, zinc, antimony, arsenic, titanium, etc. hydroxides of sodium, potassium, calcium oxides, sodium carbonate, metallic sodium, nitrogen bases, ozonides and peroxides. Blowing with air can then be continued in the presence of the polymerizing catalyst.

Several patents describe the application of phosphoric mineral acids in modifying asphalt properties. For instance, U.S. Pat. No. 2,450,756 describes a process to make oxidized asphalts by air blowing petroleum hydrocarbon in the presence of a phosphorus catalyst, including phosphorus pentoxide, phosphorus sulfide, and red phosphorus. U.S. Pat. No. 2,762,755 describes a process of air blow asphaltic material in the presence of a small amount of phosphoric acid. U.S. Pat. No. 3,126,329 discloses a method of making blown asphalt through air blowing in the presence of a catalyst which is an anhydrous solution of 50 weight percent to 80 weight percent phosphorus pentoxide in 50 weight percent to 20 weight percent phosphoric acid having the general formula $H_mR_nPO_4$.

U.S. Pat. No. 2,762,756 discloses a process for manufacturing asphalt which comprises: passing an asphalt charge stock through as ejector into which air is inducted simultaneously by the flow of the said charge stock, whereby said charge stock is dispersed in air, the ratio of said asphalt charge to air being from about 1.6 to about 5.6 gallons per minute per 1 cubic foot of air per minute, and the temperature being maintained between about 300° F. and about 550° F.; and discharging the reaction product of said asphalt charge stock and air directly into the vapor space of a separator.

United States Patent Application Publication No. 2012/0132565 A1 discloses a process for increasing the softening point of asphalt comprising the following steps: providing a liquid jet ejector comprising a motive inlet, a motive nozzle, a suction port, a main ejector body, a venturi throat and diffuser, and a discharge connection; conducting a preheated asphalt feed including fresh asphalt and recycled oxidized asphalt, at a temperature from 125° C. to 300° C., as the motive liquid into the motive inlet of the liquid jet ejector; drawing atmospheric air or compressed air into the suction port of the liquid jet ejector; mixing the preheated asphalt within the main ejector body with the air from the suction port of the liquid jet ejector to form a mixture; conducting the mixture to a heated and pressurized oxidizer vessel; collecting an off-gas from the overhead of said oxidizer vessel and an oxidized asphalt product stream from the bottoms of said oxidizer vessel, wherein said oxidized asphalt product stream has softening temperature greater than the preheated asphalt feed; and recycling a portion of the oxidized asphalt product stream back to the liquid jet ejector to form the recycled oxidized asphalt.

United States Patent Application Publication No. 2014/0262935 A1 discloses a method for oxidizing asphalt which comprises dispersing an oxygen containing gas throughout an asphalt flux in an oxidation zone while the asphalt flux is maintained at a temperature which is within the range of about 400° F. to 550° F., wherein the oxygen containing gas is introduced into the oxidation zone through a recycle loop. The recycle loop pumps asphalt flux from the oxidation zone and reintroduces the asphalt flux into the oxidation zone as oxygen enhanced asphalt flux. The recycle loop will typically include a pump which pulls the asphalt flux from the oxidation zone and which pumps the oxygen enhanced asphalt flux into the oxidation zone, and wherein the oxygen containing gas is injected into the recycle loop at a point before the asphalt flux enters into the pump.

All of the air blowing techniques described in the prior art share the common characteristic of both increasing the softening point and decreasing the penetration value of the asphalt flux treated. In other words, as the asphalt flux is air blown, its softening point increases and its penetration value decreases over the duration of the air blowing procedure. It has been the conventional practice to air blow asphalt flux for a period of time that is sufficient to attain the desired softening point and penetration value. Today there continues to be a need for a process that can be used to more efficiently air blow asphalt flux to the desired penetration value and softening point needed in specific industrial applications. For example, to air blow asphalt flux to both a softening point which is within the range of 185° F. (85° C.) to 250° F. (121° C.) and a penetration value at 77° F. (25° C.) of above 15 dmm.

SUMMARY OF THE INVENTION

This invention is based on a unique method for distribution of an oxygen containing gas throughout the asphalt flux in an air blowing process. This technique utilizes a blow still that is sectionalized with a plurality of perforated plates at various heights in the blow still. The perforated plates contain a multitude of holes which act to reduce air bubble size and improve the dispersion of the air bubbles throughout the asphalt flux. The reduced air bubble size accordingly increases the total surface area per unit volume of the air bubbles and in turn promotes a faster processing time. The perforated plates also increase the contact time between the air bubbles and the asphalt flux which further results in improved efficiency and reduced blow times. This is highly beneficial because faster processing times can be achieved which, of course, results in more efficient use of equipment, higher levels of productivity, lower energy requirements, and cost savings.

The asphalt blow still of this invention reduces the overall level of oxidizing gas, such as an oxygen containing gas (air or oxygen enhanced air), pure oxygen, chlorine enriched air, pure chlorine, and the like, needed to attain desired asphalt characteristics via the oxidation process. Accordingly, the level of carry over blow loss (the amount of asphalt blown out of the blow still during the process) can be reduced. This is, of course, highly beneficial in that the yield of oxidized asphalt is increased leading to better efficiency and less environmental impact since less volatile material is lost to the environment. In other words, by utilizing the asphalt blow still of this invention, the air blow time required to produce industrial asphalt for utilization in industrial applications, such as in manufacturing asphalt roofing shingles, can be reduced. Accordingly, utilizing the asphalt blow still of this invention increases the capacity of air blowing units and also reduces the energy consumption required to produce industrial asphalt. Because the asphalt flux is air blown for a shorter period of time the amount of blow loss (asphalt lost during the air blowing procedure) is reduced as is the amount of material emitted into the environment. Accordingly, the technique of this invention reduces the cost of raw materials and lessens the environmental impact of the air blowing procedure.

The present invention more specifically discloses a blow still which is particularly useful for air blowing asphalt flux into an industrial asphalt having a lower penetration value and a higher softening point than that of the asphalt flux, said blow still being comprised of a top end, a bottom end, and at least one side wall which extends from the bottom end to the top end and defines the side borders of the blow still, said blow still being divided into a plurality of oxidation sections by a plurality of perforated plates which are at different heights within the blow still, wherein the oxidation sections include a lowermost oxidation section which is situated at the bottom of the blow still, said blow being further comprised of an air introduction inlet which is situated within the lowermost oxidation section of the blow still.

The subject invention further reveals a method for air blowing asphalt flux into industrial asphalt comprising introducing an oxygen containing gas into asphalt which is contained within a blow still which is comprised of a top end, a bottom end, and at least one side wall which extends from the bottom end to the top end and defines the side borders of the blow still, said blow still being divided into a plurality of oxidation sections by a plurality of perforated plates which are at different heights within the blow still, wherein the oxidation sections include a lowermost oxidation section which is situated at the bottom of the blow still, said blow being further comprised of an air introduction inlet which is situated within the lowermost oxidation section of the blow still, wherein the oxidizing gas (typically air) is charged into the asphalt through the air introduction inlet for a period of time which is sufficient to decrease the penetration value of the asphalt and to increase the softening point of the asphalt while the asphalt is being maintained at a temperature which is within the range of 400° F. to 550° F.

DETAILED DESCRIPTION OF THE INVENTION

Figure 1:
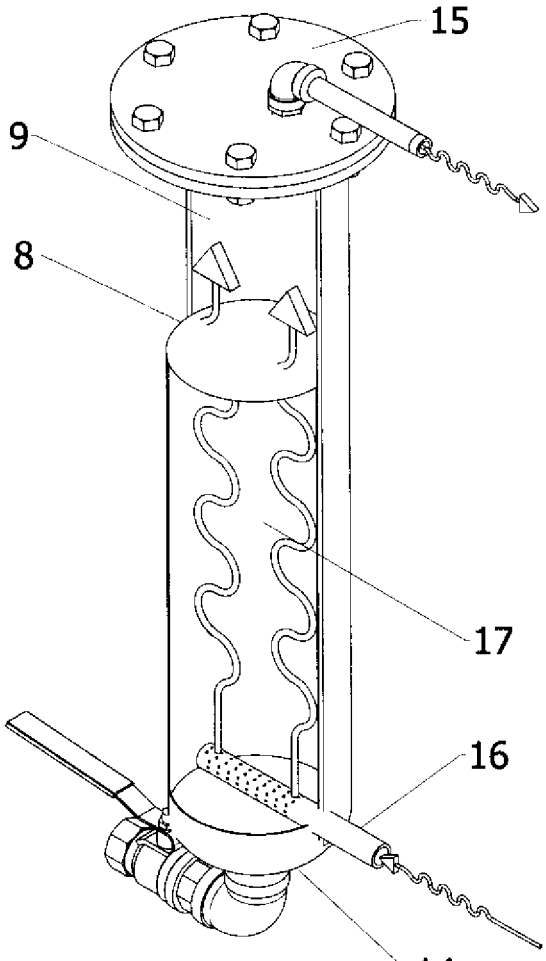
FIG. 1 is a schematic cross-sectional view of a conventional blow still which is equipped with a sparger.
Figure 2:
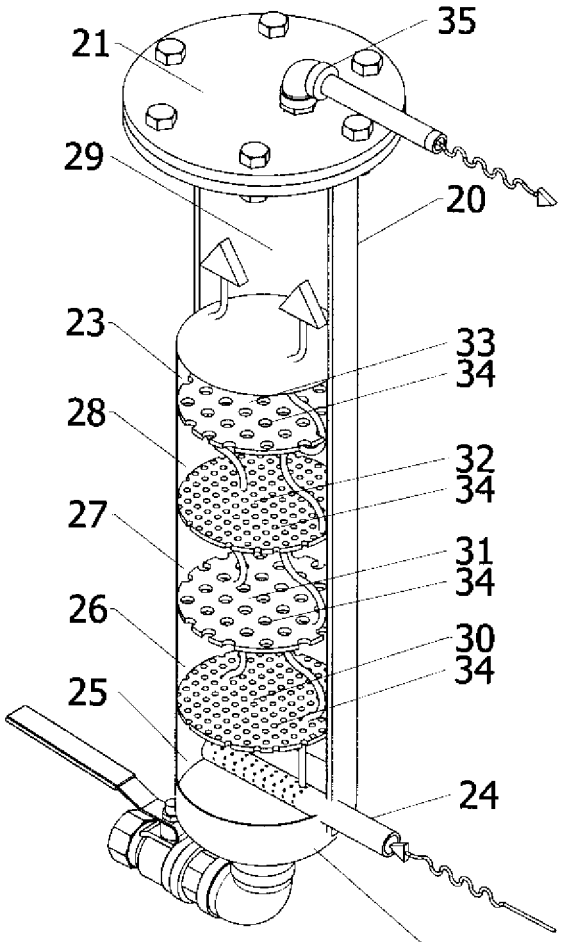
FIG. 2 is a schematic cross-sectional perspective view of a blow still of this invention which is equipped with a sparger.

FIG. 2 depicts a blow still 20 having the design of this invention. This blow still 20 has a top 21, a bottom 22, a wall 23 which encompasses the entire circumferential side of the blow still 20, and a sparger 24 as would be found in many conventional blow stills for oxidizing asphalt flux in the preparation of industrial asphalt. However, this blow still 20 differs from conventional blow stills in that it is divided into a plurality of oxidation sections 25, 26, 27, 28, and 29 by a plurality of perforated plates 30, 31, 32, and 33 which are at different heights within the blow still 20. These perforated plates 30, 31, 32, and 33 have a multitude of holes 34 in them to allow bubbles of an oxidizing gas, such as air, to flow upwardly from an air induction point (in this case the sparger 24) at the bottom of the blow still to the top of the blow still and to exit the blow still via an oxidizing gas discharge port 35.

The blow still 20 will be designed to have an appropriate number of oxidization sections and a corresponding number of perforated plates dividing the oxidization sections which will depend upon the size of the blow still, desired throughput, the characteristics of the asphalt flux being air blown, and the ultimate properties desired for the industrial asphalt being manufactured. The blow still will typically have at least 2 oxidization sections and at least one perforated plate which divides the oxidization sections, but in the case of large blow stills can have many more. The number of oxidization section is, of course, equal to the number of perforated plates plus one. In any case, a large blow still might have as many as 60 or more oxidizations zones. A typical commercial scale blow still can be designed to include from 2 to about 60 oxidization sections and might more typically contain from 4 to 30 oxidization sections. For instance, such a blow still might contain 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, or more perforated plates. In any case, the perforated plates dividing the oxidization sections will typically be spaced to provide for oxidizations sections with a relatively uniform volume. The blow stills of this invention will typically contain from 4 to 60 perforated plates and will more typically contain from 8 to 40 perforated plates. In some cases the blow stills of this invention will contain from 10 to 30 perforated plates and can contain from 12 to 20 perforated plates.

The size and number of holes in the perforated plates will also vary with the size of the blow still and the throughput desired. In any case, the holes in the perforated plates can be as small as about 1/16 inch in diameter to as large as about 4 inches in diameter. The holes will typically have a diameter which is within the range of 1/8 inch to about 2 inches. For instance, the holes can have a diameter which is within the range of 1/8 inch to 1/2 inch or 1/8 inch to 1/4 inch. In the case of large blow stills which are 40 or more feet tall the holes may be from 1/8 inch in diameter to 2 inches in diameter or may be from 1/4 inch in diameter to 1 inch in diameter. The holes will typically occupy from 30% to 75% of the area of the perforated plate and will more typically occupy from 40% to 70 percent of the area of the plate. In many cases it is preferred for the holes to occupy from 50% to 60% of the area of the perforated plate with it frequently being more preferred for the holes to occupy from about 54% to about 58% of the area of the perforated plate. The holes in the perforated plates can have a wide array of geometric configurations. For instance, the holes can be circular, ovals, star-shaped, triangular, square shaped, rectangular, polygon shaped (pentagon shaped, hexagon shaped, octagon shaped, or the like), or they can be of an irregular geometric design. However, in most cases it is preferred for the holes to be circular.

The blow still of this invention can be utilized in oxidizing virtually any type of asphalt flux. In practicing the method of this invention conventional asphalt oxidation techniques are employed with the exception of the blow still used being compartmentalized into separate oxidization sections which are divided by the perforated plates. In the technique of this invention, the asphalt flux is air blown by heating it to a temperature which is within the range of 350° F. (178° C.) to 550° F. (288° C.) and blowing an oxygen containing gas through it. This air blowing step will typically be conducted at a temperature which is within the range of 400° F. (204° C.) to 540° F. (171° C.), will preferably be conducted at a temperature which is within the range of 425° F. (218° C.) to 525° F. (274° C.) and will most preferably be conducted at a temperature which is within the range of 450° F. (232° C.) to 500° F. (260° C.). This air blowing step will typically take about 2 hours to about 10 hours and will more typically take about 3 hours to about 6 hours. However, the air blowing step will be conducted for a period of time that is sufficient to attain the ultimate desired softening point. In other words, the asphalt flux will be air blown until a softening point of at least 100° F. (38° C.) is attained.

The oxygen containing gas (oxidizing gas) is typically air. The air can contain moisture and can optionally be enriched to contain a higher level of oxygen. Chlorine enriched air or pure oxygen can also be utilized in the air blow. In any case, the air blow can be performed either with or without a conventional air blowing catalyst. Some representative examples of air blowing catalysts include ferric chloride ($FeCl_3$), phosphorous pentoxide ($P_2O_5$), aluminum chloride ($AlCl_3$), boric acid ($H_3BO_3$), copper sulfate ($CuSO_4$), zinc chloride ($ZnCl_2$), phosphorous sesquesulfide ($P_4S_3$), phosphorous pentasulfide ($P_2S_5$), phytic acid ($C_6H_6[OPO—(OH)_2]_6$), and organic sulfonic acids. The asphalt oxidation of this invention can also be conducted in the presence of a polyphosphoric acid as described in U.S. Pat. No. 7,901,563. The teachings of U.S. Pat. No. 7,901,563 are incorporated by reference herein for the purpose of describing air blowing procedures which are conducted in the presence of a polyphosphoric acid.

The industrial asphalt made can be used in making roofing products and other industrial products using standard procedures. For instance, the industrial asphalt can be blended with fillers, stabilizers (like limestone, stonedust, sand, granule, etc.), polymers, recycled tire rubber, recycled engine oil residue, recycled plastics, softeners, antifungal agents, biocides (algae inhibiting agents), and other additives. The method of this invention is primarily applicable to the preparation of industrial asphalt which is used in roofing and other industrial products. Asphalt made in accordance with this invention is particularly useful in manufacturing roofing shingles because it has the ability to bind sand, aggregate, and fillers to the roofing shingle while simultaneously providing excellent water barrier characteristics.

This invention is illustrated by the following examples that are merely for the purpose of illustration and are not to be regarded as limiting the scope of the invention or the manner in which it can be practiced. Unless specifically indicated otherwise, parts and percentages are given by weight.

Series A

This series of experiments was conducted in a lab scale blow still which was approximately 1.3 feet tall and which had a diameter of 0.35 feet. The blow still used in Examples A1, A4, and A6 was conventional in that it was not compartmentalized into different oxidization sections. However, in the other experimental runs the blow still was of the design illustrated in FIG. 2 and contained 4 perforated plates which divided the blow still into 5 oxidization sections. Circular holes having a diameter of ⅛ inch were in the perforated plates identified by reference numerals 30 and 32 in FIG. 2 and circular holes having a diameter of ¼ inch were in the perforated plates identified by reference numerals 31 and 34 in FIG. 2. The asphalt flux used as the starting material in all of these experiments had an initial penetration value which was within the range of 250 dmm to 400 dmm as measured at 77° F. In all cases the air blow temperature was held constant at 500° F.±5° F. The effect of the perforated plates had on the oxidization of the asphalt flux can be seen by reviewing Table 1.

TABLE 1

Effect of Perforated Plates on Air Blowing Time and Air Flow Rate (Asphalt Stream A)

| Example | Plates | Mass (g) | Input Flow Rate (LPM) | Air Blowing Time (Minutes) | Mass/Air flow Rate/Time (g/lpm/min) | Final Softening Point (° F.) | PEN at 77° F. (dmm) | Viscosity at 400° F. (cP) | Lab Blow Loss (%) |
|---|---|---|---|---|---|---|---|---|---|
| A1 | No | 2300 | 23.0 | 225 | 0.444 | 227 | 15.6 | 390 | 3.85 |
| A2 | Yes | 2300 | 23.0 | 152 | 0.658 | 228 | 15.0 | 354 | 3.07 |
| A3 | Yes | 2300 | 11.5 | 251 | 0.797 | 229 | 15.3 | 364 | 3.44 |
| A4 | No | 2300 | 25.3 | 187 | 0.486 | 224 | 15.6 | 276 | 4.11 |
| A5 | Yes | 2300 | 25.3 | 154 | 0.590 | 229 | 15.6 | 381 | 3.15 |
| A6 | No | 2300 | 7.4 | 696 | 0.447 | 224 | 16.0 | 297 | 2.96 |
| A7 | Yes | 2300 | 7.4 | 330 | 0.942 | 235 | 14.0 | 534 | 2.6 |
| A8 | Yes | 4400 | 7.4 | 529 | 1.124 | 228 | 15.0 | 461 | 1.97 |
| A9 | Yes | 4400 | 23.0 | 210 | 0.911 | 226 | 16.0 | 349 | 3.09 |

As can be seen from Table 1, the time needed to air blow the asphalt flux to a given softening point was greatly reduced in the experimental runs where the perforated plates were present in the blow still. It further shows that the total amount of air needed to achieve the same result was significantly reduced in the cases where the blow still was equipped with the perforated plates. This series of experiments additionally shows that blow loss was significantly reduced by including the perforated plates in the blow still.

Series B

The series of experiments was conducted in the same manner as was done in Series A except that the air blowing temperature was reduced to 475° F. in Examples B2 and B3. In this series of experiments the quantity of asphalt was held constant at 2300 grams and the air input flow rate was held constant at 23.0 LPM (liters per minute).

TABLE 2

Effect of Perforated Plates on Air Blowing Temperature (Asphalt Stream B)

| Example | Plates | Air Blowing Temperature ±5° F. (° F.) | Air Blowing Time (Minutes) | Mass/Air flow Rate/Time (g/lpm/min) | Final Softening Point (° F.) | PEN at 77° F. (dmm) | Viscosity at 400° F. (cP) | Lab Blow Loss (%) |
|---|---|---|---|---|---|---|---|---|
| B1 | No | 500 | 238 | 0.420 | 210 | 14.3 | 300 | 6.49 |
| B2 | No | 475 | 317 | 0.315 | 211 | 15.0 | 311 | 4.48 |
| B3 | Yes | 475 | 230 | 0.435 | 210 | 17.0 | 277 | 3.45 |

As can be seen from Table 2, the inclusion of the perforated plates in the blow still allowed for the air blowing temperature to be reduced which reduced the level of blow loss while still being able to attain the same increase in softening point as was realized in the conventional blow still at the higher temperature.

Series C and Series E

Figure 3:
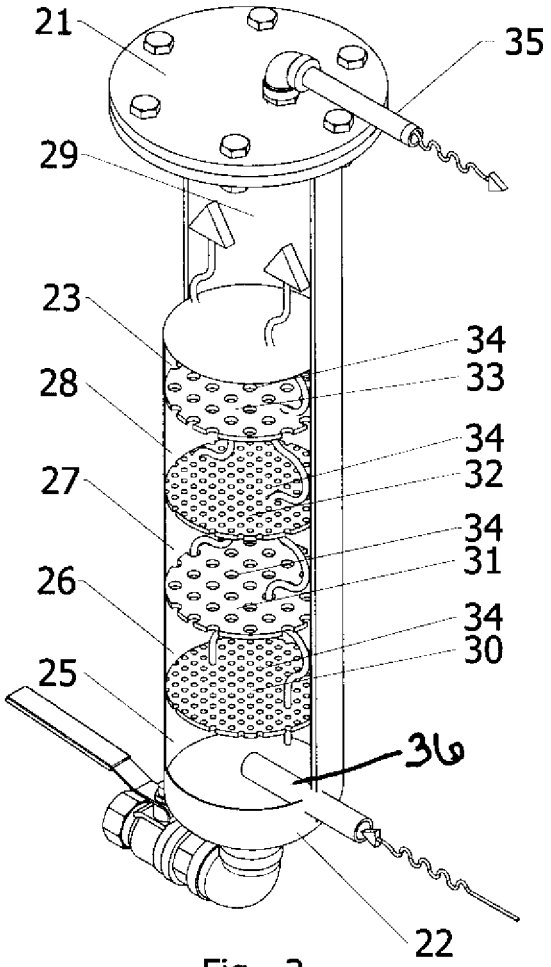
FIG. 3 is a schematic cross-sectional perspective view of a blow still of this invention which is equipped with a direct air inductor.

These experiments were conducted to study the effect of the sparger on the air blowing of asphalt. Again, the same equipment and general procedure as was used in Series A was used in these experimental runs. Series E only differed from Series C in that a different asphalt flux was used as the starting material. In Examples C3 and E3 the sparger was removed from blow still and the air was injected directly into the asphalt at the bottom of the blow still. Such a blow still which is equipped with direct air injection device 36 (direct oxidizing gas injection device) is illustrated in FIG. 3. The results of these experiments are reported in Table 3 and Table 4.

TABLE 3

Effect of Perforated Plates on Sparger Design (Asphalt Stream C)

| Example | Use Sparger | Plates | Air Blowing Time (Minutes) | Mass/Air flow Rate/Time (g/lpm/min) | Final Softening Point (° F.) | PEN at 77° F. (dmm) | Viscosity at 400° F. (cP) | Lab Blow Loss (%) |
|---|---|---|---|---|---|---|---|---|
| C1 | Yes | No | 262 | 0.382 | 227 | 16.0 | 349 | 3.21 |
| C2 | Yes | Yes | 155 | 0.645 | 231 | 15.0 | 515 | 3.46 |
| C3 | No | Yes | 152 | 0.658 | 228 | 15.0 | 354 | 3.07 |

TABLE 4

Effect of Perforated Plates on Sparger Design (Asphalt Stream E)

| Example | Use Sparger | Plates | Air Blowing Time (Minutes) | Mass/Air flow Rate/Time (g/lpm/min) | Final Softening Point (° F.) | PEN at 77° F. (dmm) | Viscosity at 400° F. (cP) | Lab Blow Loss (%) |
|---|---|---|---|---|---|---|---|---|
| E1 | Yes | No | 275 | 0.364 | 209 | 8.0 | 421 | 3.16 |
| E2 | Yes | Yes | 220 | 0.455 | 208 | 8.0 | 309 | 3.35 |
| E3 | No | Yes | 210 | 0.476 | 207 | 8.3 | 280 | 3.25 |

As can be seen from Table 3 and Table 4, removing the sparger from the blow still unexpectedly resulted in a more efficient air blow. This is exemplified by the higher mass/air flow rate/minute values that were realized when the sparger was removed from the blow still and the air was directly injected into the asphalt at the bottom of the blow still.

These examples show that the including perforated (sieve) plates which are submerged into the asphalt at various heights in an asphalt blow still (reactor) column can reduce air bubble size, improve air bubble dispersion and increase contact time with the overall effect on improving process efficiency (reduced air blow time). In conventional asphalt blowing methods, air bubbles are sparged using specially designed spargers at the bottom of the reactor (blow still) into asphalt but these bubbles typically coalesce into larger air bubbles as they travel up the column height. These larger air bubbles have decreased retention time, less total surface area and reduced oxygen diffusion efficiency.

With the perforated plates placed at various height locations in the reactor column (blow still) the larger air bubbles are then broken into smaller air bubbles and dispersed based on plate geometry, hole-size, and the occupied area in the plates. The perforated plates also reduce the kinetic energy of the air bubbles by the air bubbles dissipating energy as they travel across the holes in the perforated plates. This helps to increase the gas hold up time, further increasing the contact time at the asphalt/plate interphase and the reduction in air bubble velocity/liquid velocity helps to reduce emissions due to less stripping of light end fraction on the asphalt. The use of and placement of perforated plates narrows the gap between bubble regime and the churn-turbulent regime for a given reactor and sparger system thus enabling use of less complicated sparger designs.

The use of perforated plates and a sparger is particularly effective in a churn-turbulent regime with the result being shorter processing times for a given flow rate when compared to systems that rely solely on a sparger. The increase processing efficiency achieved by applying perforated plates could also allow for a reduction in the input air flow rate to achieve equivalent air blowing results which can enable the potential use of smaller blowers and/or blow stills. This can result in reducing installation cost, energy cost, and potentially size reduction in downstream ancillary systems and equipment for handling the fumes from the air blowing process.

As the examples show the use of perforated plates has enabled a more efficient asphalt air blowing process without the use of specialized spargers when compared to the control process which utilizes specialized spargers. In the conventional (control) asphalt blowing process, specialized spargers were designed with small holes at various orientations to create and disperse small air bubbles into the asphalt. However, the air bubbles are only small and uniformly dispersed in the vicinity of the sparger head. In conventional blow stills these small dispersed air bubbles quickly coalesce into larger bubbles and quickly rise to the tip of the blow still thus rendering them ineffective for further oxidization of asphalt. With the perforated plates of this invention in place at various heights in the reactor column, the large bubbles are broken down into small bubbles as they pass through the small holes in the perforated plates resulting in dissipation of the bubble kinetic energy. The rate at which the bubbles rise upwardly through the asphalt in the blow still is decreased giving the oxygen in the air bubbles more time to react with the asphalt (by increasing contact time). The use of the perforated plates also reduces or eliminates the cost of designing and cleaning specialized spargers having small holes numbering in the hundreds to the thousands. Eliminating spargers from blow stills also eliminates the possibility of the sparger clogging up during routine use and the problems associated therewith.

The utilization of perforated plates in blow stills can also allow for a significant reduction in the air blowing temperature without sacrificing output. Such a reduction in the oxidation temperature reduces the thermal stress generated on the reaction column during the thermal cycle of heating and cooling during the air blowing process which increases the life of the reaction column. This leads to additional cost savings by reducing the frequency of repairs performed on the reaction column and prolongs the life of the blow still by delaying the development of leaks. Blow loss is also reduced at lower temperatures due to less light end fractions being vaporized at the higher temperatures. Air blowing the asphalt at lower temperatures further allows for generating blown asphalt with a comparatively higher penetration value than would otherwise be attained due to less light fractions being stripped from the asphalt. This in turn allows for strategic asphalt sourcing and makes some asphalt streams which would not ordinarily be suitable for conventional air blowing due to low penetration values a viable alternative for air blowing with the blow still of this invention.

While certain representative embodiments and details have been shown for the purpose of illustrating the subject invention, it will be apparent to those skilled in this art that various changes and modifications can be made therein without departing from the scope of the subject invention. The illustrations and corresponding descriptions are not intended to restrict or limit the scope of the appended claims in any way.

What is claimed is:

1. A blow still comprising a top end, a bottom end, and at least one side wall which extends from the bottom end to the top end and defines the side borders of the blow still, said blow still being divided into at least two oxidation sections by at least one perforated plate, wherein the oxidation sections include a lowermost oxidation section which is situated at the bottom of the blow still, said blow still being further comprised of an air introduction inlet which is situated within the lowermost oxidation section of the blow still, wherein the air introduction inlet is a direct air injection device.

2. The blow still of claim 1 wherein the blow still contains one or a plurality of perforated plates, and wherein the perforated plates contain a plurality of holes.

3. The blow still of claim 2 wherein the holes have a geometry selected from the group consisting of circular holes, oval shaped holes, star-shaped holes, triangular holes, square holes, rectangular holes, polygon shaped holes, and holes of irregular designs.

4. The blow still of claim 2 wherein the holes are circular holes having a diameter which is within the range of 1/16 inch to 3 inches.

5. The blow still of claim 2 wherein the holes are circular holes having a diameter which is within the range of 1/8 inch to 1/2 inches.

6. The blow still of claim 2 wherein the holes are circular holes having a diameter which is within the range of 1/8 inch to 1/4 inches.

7. The blow still of claim 2 wherein the holes are circular holes having a diameter which is within the range of 1/2 inch to 1 inches.

8. The blow still of claim 2 wherein the holes occupy from 30% to 75% of the area of the perforated plate.

9. The blow still of claim 2 wherein the holes occupy from 40% to 70% of the area of the perforated plate.

10. The blow still of claim 2 wherein the holes occupy from 52% to 60% of the area of the perforated plate.

11. The blow still of claim 2 wherein the blow still has a plurality of oxidization sections which are divided by a plurality of perforated plates which are at different heights within the blow still.

12. The blow still of claim 2 wherein the blow still includes at least 2 of the perforated plates.

13. The blow still of claim 2 wherein the blow still includes at least 3 of the perforated plates.

14. The blow still of claim 2 wherein the blow still includes at least 4 of the perforated plates.

15. The blow still of claim 2 wherein the blow still includes from 4 to 60 perforated plates.

16. The blow still of claim 2 wherein the blow still includes from 12 to 20 perforated plates.

17. The blow still of claim 1 wherein the air introduction inlet is not a sparger.

18. A method comprising introducing an oxidizing gas into asphalt which is contained within the blow still as specified in claim 17 by charging the oxidizing gas into the asphalt through the air introduction inlet for a period of time which is sufficient to decrease the penetration value of the asphalt and to increase the softening point of the asphalt while the asphalt is being maintained at a temperature which is within the range of 350° F. to 550° F.

19. The method of claim 18 wherein said method is a batch process.

20. A method comprising introducing an oxidizing gas into asphalt which is contained within a blow still as specified in claim 1 by charging the oxidizing gas into the asphalt through the air introduction inlet for a period of time which is sufficient to decrease the penetration value of the asphalt and to increase the softening point of the asphalt while the asphalt is being maintained at a temperature which is within the range of 350° F. to 550° F.

21. The method of claim 20 wherein said method is a batch process.

* * * * *